US005111765A

United States Patent [19]

Kobayashi

[11] Patent Number: 5,111,765

[45] Date of Patent: May 12, 1992

[54] HULL CONSTRUCTION FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 478,572

[22] Filed: Feb. 9, 1990

[30] Foreign Application Priority Data

Feb. 9, 1989 [JP] Japan ..... 1-31871

[51] Int. Cl.[5] ..... B63B 43/02

[52] U.S. Cl. ..... 114/270; 114/360; 114/361

[58] Field of Search ..... 114/361, 349, 68, 69, 114/270, 360, 345, 123; 441/38

[56] References Cited

U.S. PATENT DOCUMENTS

| | | | |
|---|---|---|---|
| 2,096,167 | 10/1937 | Farrugia | 114/349 |
| 3,222,700 | 12/1965 | Smith | 441/38 |
| 3,659,298 | 5/1972 | Edwards | 114/345 |
| 4,771,722 | 9/1988 | Tihany | 114/345 |
| 4,942,838 | 7/1990 | Boyer et al. | 114/345 |

FOREIGN PATENT DOCUMENTS

| | | | |
|---|---|---|---|
| 2017747 | 1/1972 | Fed. Rep. of Germany | 114/345 |
| 864382 | 4/1961 | United Kingdom | 441/38 |

*Primary Examiner*—Sherman D. Basinger
*Attorney, Agent, or Firm*—Ernest A. Beutler

[57] ABSTRACT

A small jet propelled watercraft having a partially open rider's area covered at least in part by a roof. The construction and orientation of the roof is such to insure that the watercraft cannot be inverted in the water.

5 Claims, 4 Drawing Sheets

HULL CONSTRUCTION FOR SMALL WATERCRAFT

BACKGROUND OF THE INVENTION

This invention relates to a hull construction for a small watercraft and more particularly to an improved hull construction that will insure that the watercraft cannot be inverted in the water regardless of the circumstances.

There is a very popular type of small watercraft that is powered by a jet propulsion unit and which is designed to be operated by one rider and one or more passengers. This type of watercraft is quite sporting in nature and in one form the occupants sit on the watercraft in a straddle fashion. That type of watercraft is more sporting in nature and the occupants expect to become wet and even expect the watercraft to capsize at times. However, this type of watercraft also can have appeal for other uses than such sporting uses but the type of watercraft previously proposed do not offer significant weather protection or protection from inversion in the water for such applications.

It is, therefore, a principal object of this invention to provide an improved hull construction for a small watercraft in which the occupants would be given some protection from the elements and also in which the watercraft cannot become inverted in the water regardless of its condition.

It is a further object of this invention to provide an improved hull construction for a small watercraft that will insure that the watercraft cannot be inverted.

SUMMARY OF THE INVENTION

This invention is adapted to be embodied in a small watercraft having a hull that defines a rider's compartment. A roof extends over at least a portion of the rider's and is at such a height and has sufficient buoyancy so as to insure that the watercraft cannot be completely inverted in the water regardless of the condition.

DETAILED DESCRIPTION OF THE PREFERRED EMBODIMENT OF THE INVENTION

Figure 1:
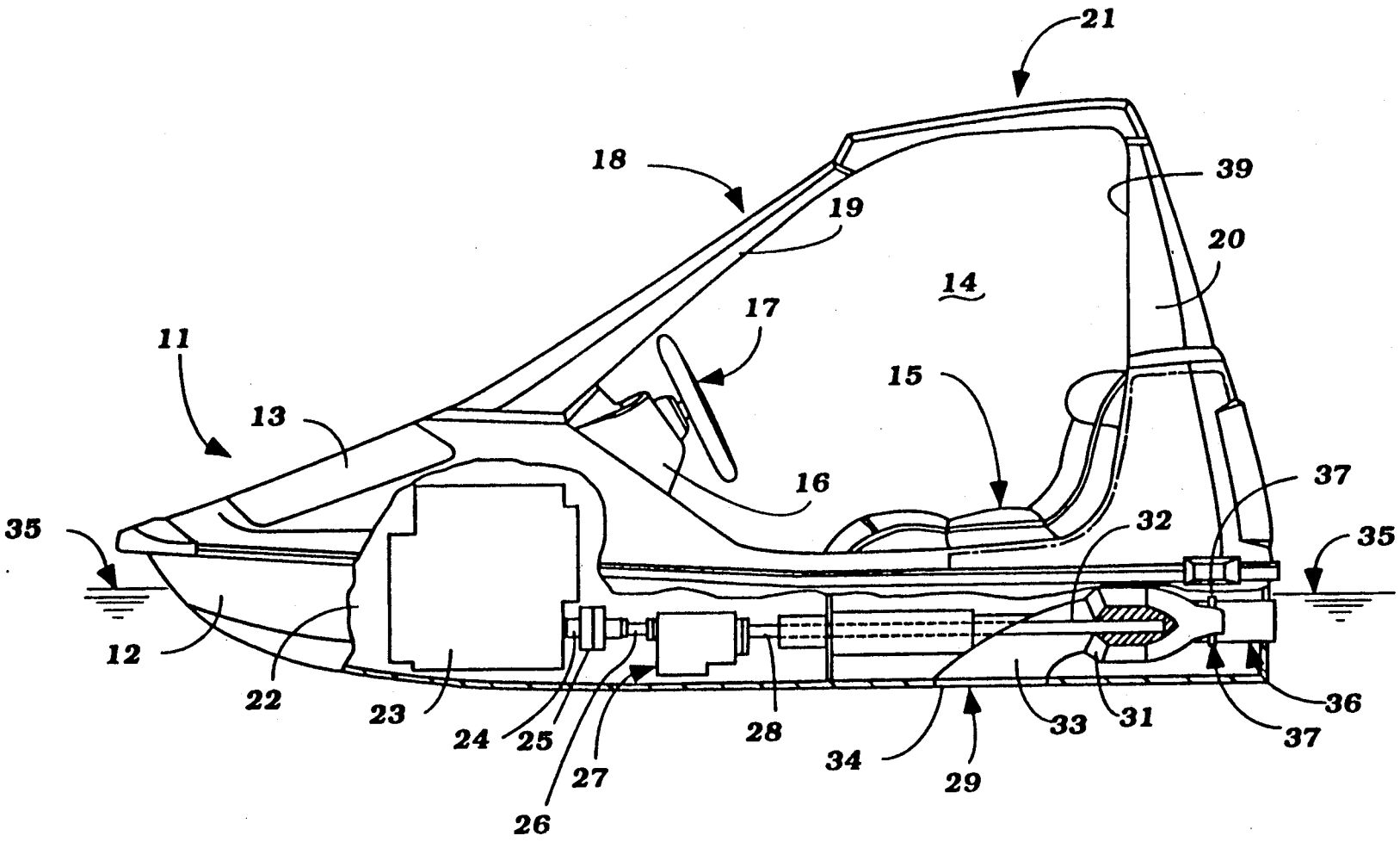
FIG. 1 is a side elevational view of a small watercraft constructed in accordance with an embodiment of this invention
Figure 2:
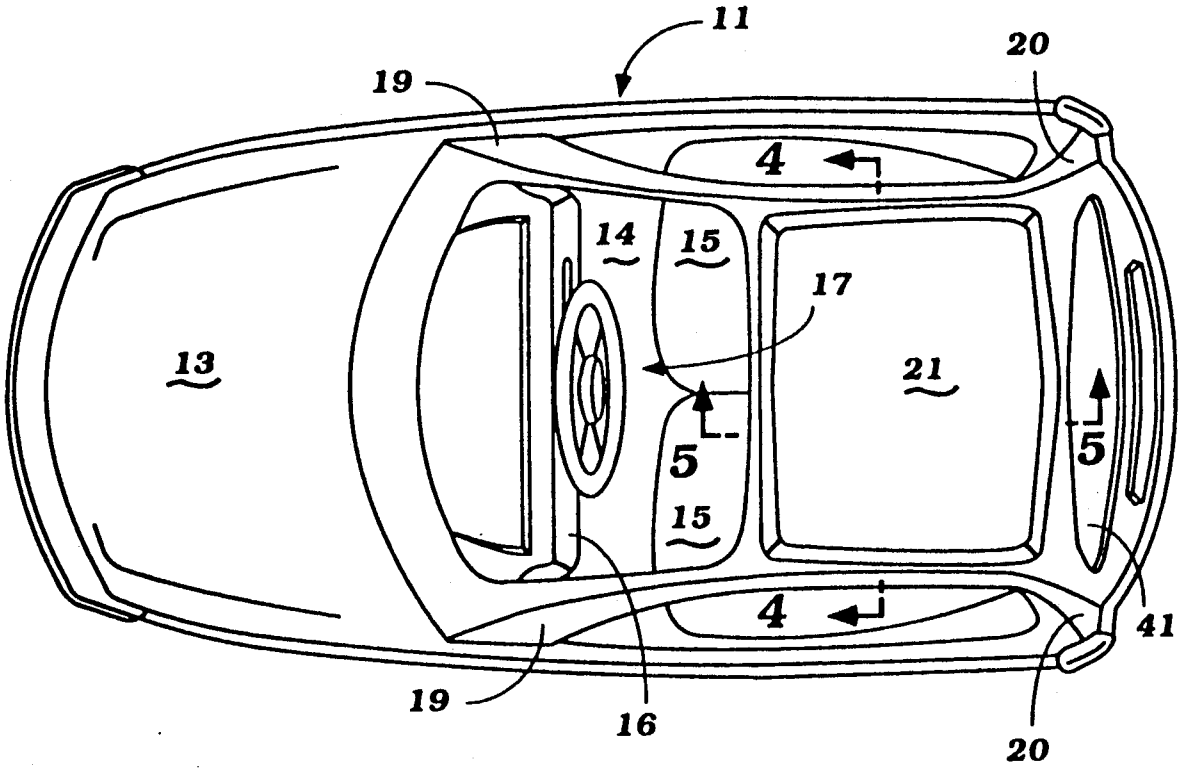
FIG. 2 is a top plan view of the watercraft.

A small watercraft powered by a jet propulsion system and constructed in accordance with an embodiment of the invention is identified generally by the reference numeral 11. The watercraft 11 is comprised of a hull that is made up of a lower hull portion 12 and an upper deck portion 13 that are affixed to each other in a known manner. The hull portion 12 and deck portion 13 may be conveniently formed from a molded fiberglass reinforced resin or the like.

A rider's area 14 is provided by the hull and contains a seat 15 in which a rider and one or more passengers may be positioned. A bridge 16 is positioned ahead of the seat 15 and contains a steering wheel 17 for steering the watercraft in a manner to be described.

In accordance with the invention the watercraft is partially enclosed and has a windshield 18 and upstanding pairs of side and rear pillars 19 and 20 to which a roof 21 is secured in a suitable manner so as to provide a partial enclosure for the occupants.

The hull defines a forwardly positioned engine compartment 22 in which an internal combustion engine 23 of any known type may be provided. The engine 23 has an output shaft 24 that is coupled by means of a coupling 25 to an input shaft 26 of a combined transmission and self cleaning unit, indicated generally by the reference numeral 27, the construction and operation of which is described in my copending application entitled "Cleaning Arrangement for Water Jet Propulsion", Ser. No. 457,552, filed Dec. 27, 1989 and assigned to the Assignee hereof.

The unit 27 has an output shaft 28 that is connected to drive a jet propulsion unit, indicated generally by the reference numeral 29 positioned in a tunnel at the rear of the lower hull portion 12. The jet propulsion unit 29 is comprised of a main housing assembly which defines a volute casing in which an impeller 31 is journaled. The impeller 31 is affixed to a driveshaft 32 that is coupled to the output shaft 28 of the self cleaning unit 27 in a suitable manner.

The jet propulsion unit 29 further includes a water inlet portion 33 having a downwardly facing water inlet opening 34 that is positioned below the water level 35 in which the watercraft is operating. Water is drawn in through the inlet 34 and passage 33 by the operation of the impeller 31 and is discharged through a discharge, steering nozzle 36 supported for pivotal movement by pivot pins 37. The nozzle 36 is coupled to the steering wheel 17 for steering movement in a known manner.

Figure 3:
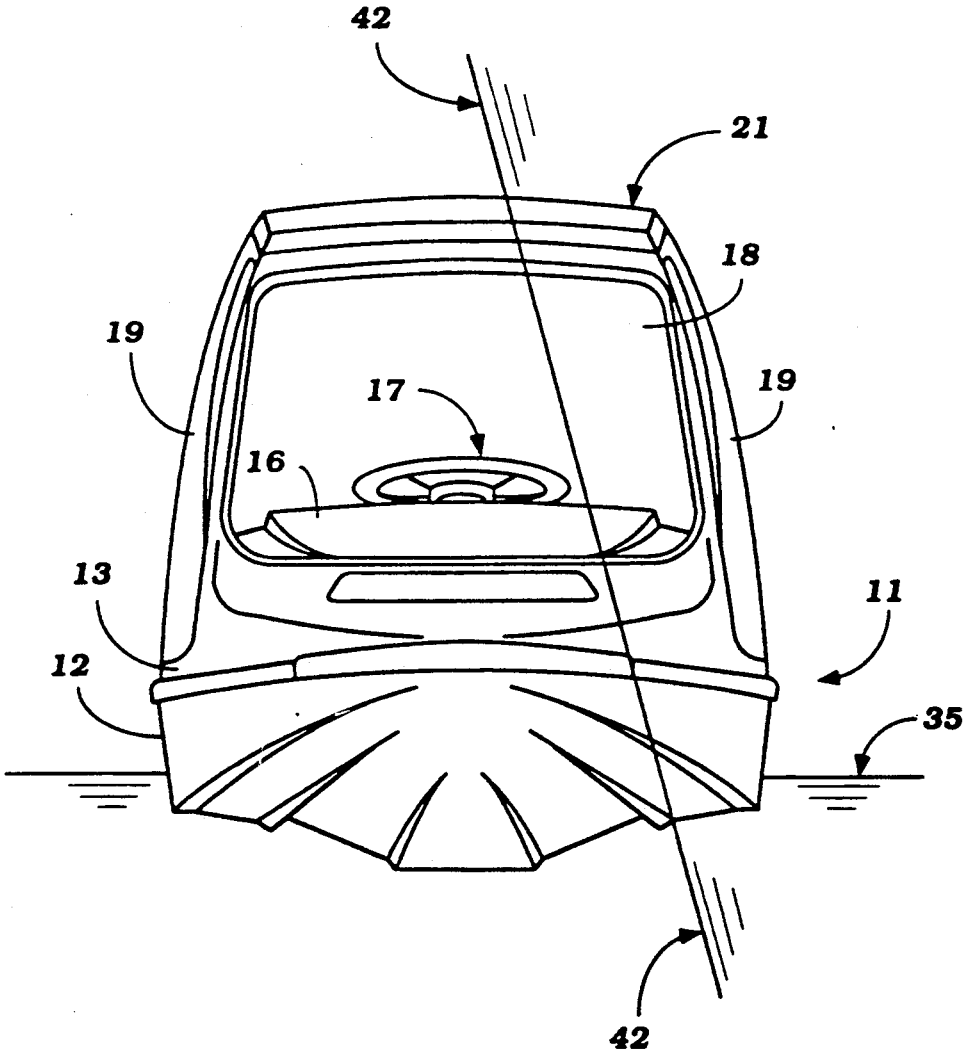
FIG. 3 is a front elevational view of the watercraft showing the normal waterline and also the waterline when the watercraft capsizes.

It should be readily apparent that the windshield 18 and roof 21 will give some protection to the driver and passenger during operation through the water. Of course, the watercraft is provided with large side openings 39 and rear window opening 41 so that fresh air can be drawn in and to afford ease of entry and exit. However, there is always the possibility that the watercraft may capsize and due to the openings water could fill the passenger compartment 14. It is desirable, however, to insure that the watercraft cannot be fully inverted so that the operator or passengers can easily right the watercraft 11 and re-enter it. For this purpose, the roof 21 is positioned at a sufficient height and has sufficient buoyancy to insure that the maximum degree of submersion permissible for the watercraft because of its inherent buoyancy is as shown by the displaced waterline 42 in FIG. 3. As may be readily seen from this figure, when the watercraft is capsized, it will be easy to right because of its buoyancy and because of the openings 39 and 41 which will let water drain out.

Figure 4:
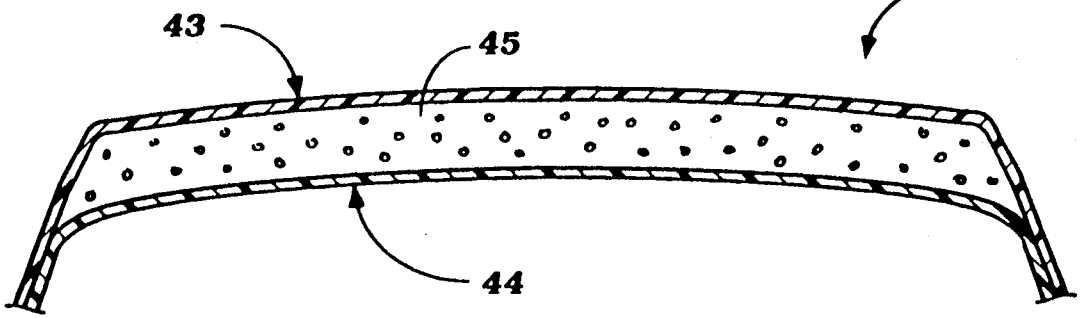
FIG. 4 is an enlarged cross-sectional view taken along the line 4—4 of FIG. 2.
Figure 5:
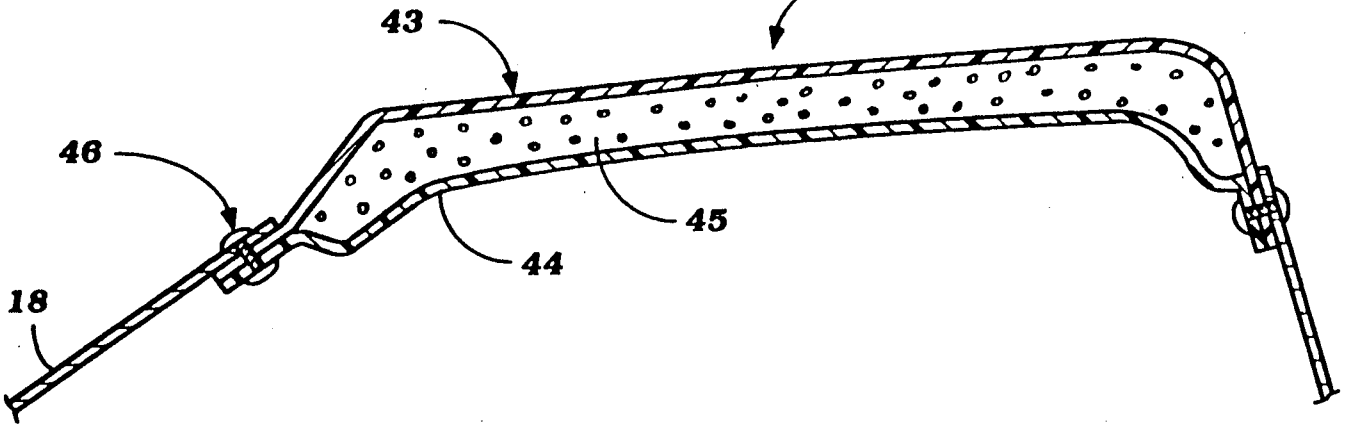
FIG. 5 is an enlarged cross-sectional view taken along the line 5—5 of FIG. 2.

Referring to FIG. 4, it would be seen that the roof 21 is formed of a double wall construction having an outer panel 43 and an inner panel 44 that define a buoyant area. In order to insure further buoyancy, a foamed plastic material 45 is placed into the hollow opening so as to insure that water cannot even leak into this area and the buoyancy will be maintained.

This figure further shows how the windshield 18 is secured to the roof at its forward end by fasteners 46.

It should be apparent from the foregoing description that the described watercraft provides a sporting nature and still will protect the riders from the element to some extent and also will insure that the watercraft cannot become fully inverted even if capsized.

It is to be understood that the foregoing description is that of a preferred embodiment of the invention and various changes and modifications may be made without departing from the spirit and scope of the invention, as defined by the appended claims.

I claim:

1. A hull construction for a small watercraft having a rigid hull defining a rider's compartment containing a seat for accommodating one or more riders seated in side by side fashion and a rigid roof supported at least in part above said rider's compartment by means of a pair of upwardly and rearwardly inclined rigid front pillars and a rigid upwardly extending rear pillar, said roof having sufficient height and buoyancy so as to prevent the watercraft from coming inverted even if capsized, said roof, pillars and hull defining generally open sides for access to said rider's seat and to permit water to be drained therefrom if the watercraft is capsized so as to facilitate righting thereof.

2. A hull construction for a small watercraft as set forth in claim 1 further including an engine compartment at a forward portion of the hull and containing an internal combustion engine and a jet propulsion device driven by said engine and positioned in a tunnel at the rear of said hull for propelling the watercraft.

3. A hull construction for a small watercraft as set forth in claim 2 wherein the roof has double walled construction and is filled with a buoyant material.

4. A hull construction for a small watercraft as set forth in claim 1 wherein the roof has a double walled construction and is filled with a buoyant material.

5. A hull construction as set forth in claim 1 further including a windshield supported by the hull between said front pillars and the forward of said roof.

* * * * *

UNITED STATES PATENT AND TRADEMARK OFFICE

CERTIFICATE OF CORRECTION

PATENT NO. : 5,111,765

DATED : May 12, 1992

INVENTOR(S) : Noboru Kobayashi

It is certified that error appears in the above-identified patent and that said Letters Patent is hereby corrected as shown below:

Column 5, line 19, Claim 5, after "forward" insert --portion--.

Signed and Sealed this

Twenty-eighth Day of September, 1993

Bruce Lehman

*Attest:*

BRUCE LEHMAN

*Attesting Officer*

*Commissioner of Patents and Trademarks*